US012590387B2

(12) United States Patent
Oguni

(10) Patent No.: US 12,590,387 B2
(45) Date of Patent: Mar. 31, 2026

(54) CELLULOSE ACETATE BAND, AND METHOD FOR PRODUCING CELLULOSE ACETATE BAND

(71) Applicant: DAICEL CORPORATION, Osaka (JP)

(72) Inventor: Kazuma Oguni, Tokyo (JP)

(73) Assignee: DAICEL CORPORATION, Osaka (JP)

( * ) Notice: Subject to any disclaimer, the term of this patent is extended or adjusted under 35 U.S.C. 154(b) by 0 days.

(21) Appl. No.: 16/623,889

(22) PCT Filed: Nov. 22, 2017

(86) PCT No.: PCT/JP2017/042045
§ 371 (c)(1),
(2) Date: Dec. 18, 2019

(87) PCT Pub. No.: WO2019/012712
PCT Pub. Date: Jan. 17, 2019

(65) Prior Publication Data

US 2020/0131670 A1 Apr. 30, 2020

(30) Foreign Application Priority Data

Jul. 11, 2017 (JP) ..... 2017-135268

(51) Int. Cl.
*D01F 2/30* (2006.01)
*D01F 2/28* (2006.01)

(52) U.S. Cl.
CPC ..... *D01F 2/30* (2013.01); *D01F 2/28* (2013.01); *Y10T 428/2922* (2015.01); *Y10T 428/2965* (2015.01)

(58) Field of Classification Search
CPC ..... D01F 2/28; Y10T 428/2922; Y10T 428/2965; D01D 5/22
See application file for complete search history.

(56) References Cited

U.S. PATENT DOCUMENTS 2,070,031 A 2/1937 Stone et al.
2,238,977 A 4/1941 Jackson et al.
(Continued)

FOREIGN PATENT DOCUMENTS

CN 101864608 A 10/2010
DE 69306801 T2 4/1997
(Continued)

OTHER PUBLICATIONS

Machine Translation of JP63309173A (Year: 1988).*
(Continued)

*Primary Examiner* — Jenna N Chandhok
(74) *Attorney, Agent, or Firm* — XSENSUS LLP

(57) ABSTRACT

The problem to be solved by the present invention is to prevent interruption of a cellulose acetate fiber during spinning of the cellulose acetate fiber thereby enhancing production efficiency of a cellulose acetate band. The cellulose acetate band according to an embodiment of the present invention is formed from cellulose acetate fibers, a total denier thereof is set to a value in a range from 8000 to 44000, a content of titanium oxide is set to a value in a range from 0 wt. % to 0.01 wt. %, and a content of a lubricant in the band measured by a diethyl ether extraction method is set to a value in a range greater than 5 mg but 65 mg or less per 1 m.

3 Claims, 2 Drawing Sheets

(56) References Cited

U.S. PATENT DOCUMENTS

| | | | |
|---|---|---|---|
| 10,470,490 | B2 | 11/2019 | Karakane et al. |
| 2004/0237982 | A1 | 12/2004 | Dollhopf et al. |
| 2005/0126582 | A2 | 6/2005 | Dollhopf et al. |
| 2005/0287368 | A1 | 12/2005 | Corallo et al. |
| 2005/0288163 | A1 | 12/2005 | Caenen et al. |
| 2013/0115452 | A1 | 5/2013 | Bundren et al. |
| 2017/0020749 | A1 | 1/2017 | Nakamura et al. |

FOREIGN PATENT DOCUMENTS

| | | | | |
|---|---|---|---|---|
| DE | 69518724 | T2 | | 5/2001 |
| DE | 10121310 | A1 | | 11/2002 |
| DE | 69333157 | T2 | | 6/2004 |
| DE | 60036202 | T2 | | 5/2008 |
| EP | 0660888 | B1 | | 12/1996 |
| EP | 0716117 | B1 | | 9/2000 |
| EP | 0792913 | B1 | | 8/2003 |
| EP | 1167589 | B1 | | 8/2007 |
| EP | 3 095 335 | A1 | | 11/2016 |
| EP | 3128070 | A1 | | 2/2017 |
| EP | 3653765 | B1 | | 6/2024 |
| GB | 949505 | | | 10/1960 |
| GB | 907299 | A | | 10/1962 |
| JP | 63309173 | A | * | 12/1988 |
| JP | H08500152 | A | | 1/1996 |
| JP | 2000313894 | A | | 11/2000 |
| JP | 2007-77525 | A | | 3/2007 |
| KR | 10-2010-0036972 | A | | 4/2010 |
| KR | 10-2017-0019336 | A | | 2/2017 |
| WO | 9324685 | A1 | | 12/1993 |
| WO | 2006007013 | A2 | | 1/2006 |
| WO | 2011048420 | A1 | | 4/2011 |
| WO | 2012177482 | A1 | | 12/2012 |
| WO | 2012177483 | A1 | | 12/2012 |
| WO | 2013067503 | A1 | | 5/2013 |
| WO | 2013067511 | A2 | | 5/2013 |
| WO | 2014018492 | A1 | | 1/2014 |
| WO | WO 2015/152335 | A1 | | 10/2015 |

OTHER PUBLICATIONS

Extended European Search Report issued Mar. 12, 2021, in European Patent Application No. 17917790.2.

English translation of International Preliminary Report on Patentability and Written Opinion mailed Jan. 23, 2020, in PCT/JP2017/042045 (Forms PCT/IB/326, PCT/IB/373, and PCT/ISA/237).

International Search Report mailed Feb. 20, 2018, in PCT/JP2017/042045.

Rustemeyer, "Cellulose Acetates: Properties and Applications, 5.2 CA Filter Tow for Cigarette Filters," Macromol.Symp. (2004), vol. 208, pp. 267-291.

Japanese Office Action for Japanese Application No. 2017-135268, dated Jan. 11, 2022, with English translation.

Office Action issued in Japanese Patent Application No. 2017-135268 dated May 10, 2022.

European Office Action for European Application No. 17 917 790.2, dated May 25, 2023.

"ANSES's proposal for titanium dioxide to be classified as carcinogenic by inhalation submitted for public consultation", ECHA (European Chemicals Agency), Jun. 9, 2016, total 2 pages.

"Cellulose Acetates: Properties and Applications", Macromolecular Symposia, WILEY-VCH, Mar. 2004, ISBN 3-527-31041-X, Heidelberg, Germany, total 20 pages.

Alan Norman, "Cigarette Design and Material", in: TOBACCO Production, Chemistry and Technology, Wiley-Blackwell, published in 1999, United States, total 20 pages.

Lot S-3133, Sample Bale Request and Test Result, Public Prior Use by Eastman Chemical Company, produced on Apr. 5, 2017, Kingsport, Tennessee, United States, total 6 pages.

* cited by examiner

CELLULOSE ACETATE BAND, AND METHOD FOR PRODUCING CELLULOSE ACETATE BAND

TECHNICAL FIELD

The present invention relates to a cellulose acetate band and a method for producing a cellulose acetate band.

BACKGROUND ART

In the present specification, terms defined as described below are used.

TD: An abbreviation of a total denier referring to denier (the number of grams per 9000 m) of an assembly of tows (band).

FD: An abbreviation of filament denier, i.e., a denier per filament, referring to denier (the number of grams per 9000 m) of a single fiber (one piece of filament). Also referred to as single fiber denier.

Filament: A continuous long fiber particularly referring to a single fiber extruded from the spinneret hole described below.

Spinneret hole: An orifice of the spinneret described below that extrudes a filament.

Band: Formed by crimping tows (an assembly of filaments). The tows, which are an assembly of filaments (single fiber) that are extruded from each of a plurality of cabinets, are combined with the TD for the tows set to a predetermined value. The combined crimped tows are called a band. Therefore, the band has a TD and a crimp-index. The band is packed in a bale form.

Tow: A filaments lie extruded from spinneret holes. End and yarn are each an aspect of the tow.

End: An n assembly of filaments having a predetermined total denier obtained by combining (bundling) a plurality of filaments extruded from a plurality of spinneret holes.

Yarn: A bundle of filaments spun by one cabinet. Therefore, the yarn is an assembly of filaments before combining.

Fibers formed from cellulose acetate, especially, from cellulose diacetate, are useful as materials for cigarette filters used in cigarettes, e.g., e-cigarettes, and as materials for sanitary articles, etc. For these use, cellulose acetate bands formed from cellulose acetate fibers are used.

In general, in a case where a cellulose acetate fiber is spun, a spin dope (also referred to as "dope") obtained by dissolving cellulose acetate in an organic solvent is extruded from a spinneret hole of a spinneret. Spinning (formation) is then performed by vaporizing the solvent in the spin dope. Titanium oxide is an essential component included in a known spin dope, for example, as a matting agent of the cellulose acetate fibers. In a case where the cellulose acetate fibers are spun, acetone is often used as the organic solvent included in the spin dope. (Non-Patent Document 1)

As described in Patent Document 1, in a case where a cellulose acetate band (hereinafter, also simply referred to as "band") is produced, a yarn is formed from a plurality of cellulose acetate fibers. A plurality of yarns are combined to form a tow. The tow is crimped to produce a band. The band is packed in a packaging box and subjected to compression packing.

Patent Document 2 describes technology that aims at enhancing spinnability by adding a certain type of titanium compound (e.g., titanium chelate compound) into a spin dope to enhance the viscosity of the spin dope.

CITATION LIST

Patent Document

Non-Patent Document 1: Issue edited by: P. Rustemeyer. March 2004. Cellulose Acetates: Properties and Applications. Pages 266-281

Patent Document 1: JP 2004-068198 A

Patent Document 2: GB 949505 A

SUMMARY OF INVENTION

Technical Problem

A band has excellent characteristics because of cellulose acetate fibers, but the demand for reduction of production cost thereof through enhancement of production efficiency has been growing. However, when cellulose acetate fibers are spun at a high speed, interruption of the cellulose acetate fibers may occur, and enhancement of the production efficiency may be difficult.

An object of the present invention is to prevent interruption of cellulose acetate fibers during spinning of the cellulose acetate fibers thereby enhancing production efficiency of a cellulose acetate band.

Solution to Problem

As a result of study conducted by the inventor of the present invention, it was found that occurrence of interruption of cellulose acetate fibers during spinning of the cellulose acetate fibers is caused by titanium oxide included in a band. It was thus found that such interruption can be prevented by spinning the cellulose acetate fibers such that the titanium oxide content in a produced band is as small as possible. In particular, it was found that, in a case where a band with a large denier per filament is produced, preferably the cellulose acetate fibers are spun such that the titanium oxide content in the produced band is as small as possible.

Furthermore, in light of common general technical knowledge, titanium oxide is considered to reduce frictional resistance of a cellulose acetate fiber because the titanium oxide increases recesses and protrusions on the fiber surface. However, according to the study of the inventor of the present invention, when the titanium oxide content of a produced band was reduced, the frictional resistance of cellulose acetate fibers decreased. As a result, frictional forces on the cellulose acetate fibers decreased when the cellulose acetate fibers were guided in a predetermined direction, especially when crimping was performed, in a production device.

Excessively large frictional forces on the cellulose acetate fibers exerted from a guiding member may cause fly (linting and short fibrous substances) of cellulose acetate fibers. On the other hand, excessively small frictional forces on the cellulose acetate fibers exerted from the guiding member may cause unstable guiding of the cellulose acetate fibers (yarn and end) at the guiding member. In particular, the relative positional relationship between an end and a nip roll when the end enters into a crimping device may fluctuate, whereby the crimping may not be performed uniformly. The band that has undergone such crimping has an uneven crimp state. Therefore, in a case where the band is used for production of cigarette filters, problems may arise from variation of pressure drop of the cigarette filters in the length direction of the band.

Thus, it is important to appropriately guide and crimp the cellulose acetate fibers, and, for this purpose, it is necessary to set the frictional resistance of the cellulose acetate fibers to a particular range. In particular, in a case where a band having a high rate of crimp-index is used, the problem described above becomes evident. The problem described above is, particularly, observed in a band having a small total denier. Therefore, it is difficult to produce a band having a small total denier, a high rate of crimp-index, and a low content of titanium oxide. Furthermore, even if crimping can be performed successfully, quality of the band may be compromised. The present invention is based on such findings.

The cellulose acetate band according to an embodiment of the present invention is formed from cellulose acetate fibers, a total denier thereof is set to a value in a range from 8000 to 44000, a content of titanium oxide therein is set to a value in a range from 0 wt. % to 0.01 wt. %, and a content of a lubricant in the band measured by a diethyl ether extraction method is set to a value in a range greater than 5 mg but 65 mg or less per 1 m.

According to the configuration described above, in a case where the cellulose acetate band having the total denier set to a value in a range from 8000 to 44000 is produced, the content of the titanium oxide in the cellulose acetate band can be set as small as possible to an extent that the cellulose acetate band contains substantially no titanium oxide. Therefore, in a case where cellulose acetate fibers are spun at a high speed, interruption of the cellulose acetate fibers immediately below a spinneret can be suitably prevented.

Furthermore, according to the configuration described above, the content of the lubricant in the band measured by the diethyl ether extraction method is set to a value in a range greater than 5 mg but 65 mg or less per 1 m. Therefore, in a case where the cellulose acetate fibers, for which the content of titanium oxide is set as described above, are, for example, guided or crimped in a predetermined direction, decrease of frictional forces externally applied to the cellulose acetate fibers can be prevented. In particular, faulty crimping due to decreased frictional resistance during crimping of the cellulose acetate fibers can be suppressed. Therefore, a high-quality cellulose acetate band can be stably produced.

The denier per filament may be set to a value in a range from 1.0 to 12.0. Thus, interruption of the cellulose acetate fibers during spinning of the cellulose acetate fibers can be prevented. Furthermore, flexibility in setting the denier per filament of the cellulose acetate band can be enhanced.

The denier per filament may be set to a value in a range of 1.0 or greater but less than 5.0; and the cellulose acetate fibers are crimped; and crimping (%) of the band calculated by Equation 1 may be set to a value in a range from 10% to 40%;

$$\text{Crimping (\%)}=[(L1-L0)/L0]\times 100 \quad \text{[Equation 1]}$$

where L0 is a length of the band in a case where a load of 250 g is applied to the band having a length of 250 mm in a direction in which crimp of the cellulose acetate fibers is stretched, and L1 is a length of the band in a case where a load of 2500 g is applied to the band having the length of 250 mm in the direction described above.

According to the configuration described above, interruption of relatively thin cellulose acetate fibers, in which the denier per filament is set at a value in a range of 1.0 or greater but less than 5.0, can be prevented during spinning. Furthermore, by setting the crimping (%) of cellulose acetate band to a value in a range from 10% to 40%, a suitably crimped cellulose acetate band can be stably produced.

The denier per filament may be set to a value in a range from 5.0 to 9.0; the total denier may be set to a value in a range from 15000 to 20000; a content of a lubricant in the band measured by a diethyl ether extraction method may be set to a value in a range from 10 mg to 30 mg per 1 m; and the cellulose acetate fibers are crimped, and crimping (%) of the band calculated by Equation 1 may be set to a value in a range of 10% to 30%;

$$\text{Crimping (\%)}=[L1-L0)/L0]\times 100 \quad \text{[Equation 1]}$$

where L0 is a length of the band in a case where a load of 250 g is applied to the band having a length of 250 mm in a direction in which crimp of the cellulose acetate fibers is stretched, and L1 is a length of the band in a case where a load of 2500 g is applied to the band having the length of 250 mm in the direction described above.

According to the configuration described above, by setting the filament denier to a value in a range from 5.0 to 9.0 and the total denier to a value in a range from 15000 to 20000, a suitably crimped band, in which the crimping (%) is set to the value in the range described above, can be obtained even when a relatively large denier per filament and a relatively small total denier are set.

The method for producing a cellulose acetate band according to an embodiment of the present invention includes: dissolving cellulose acetate to prepare a spin dope; spinning a plurality of cellulose acetate fibers using the spin dope such that a total denier of a band after production is set to a value in a range of 8000 to 44000; and applying a lubricant to the cellulose acetate fibers such that a content of the lubricant in the band after production measured by a diethyl ether extraction method is set to a value in a range of greater than 5 mg but 65 mg or less per 1 m; wherein, in the dissolving cellulose acetate to prepare the spin dope, the spin dope is adjusted such that a content of titanium oxide in the band after production is set to a value in a range from 0 wt. % to 0.01 wt. %.

According to the method described above, in a case where the cellulose acetate band having the total denier set to a value in a range of 8000 to 44000 is produced, the content of the titanium oxide in the cellulose acetate band can be set as small as possible to an extent that the cellulose acetate band contains substantially no titanium oxide. Therefore, in a case where cellulose acetate fibers are spun at a high speed in the spinning, interruption of the cellulose acetate fibers immediately below a spinneret can be suitably prevented.

Furthermore, according to the method described above, the lubricant is applied to the cellulose acetate fibers in the applying the lubricant such that the content of the lubricant in the band after production measured by the diethyl ether extraction method is set to a value in a range of greater than 55 mg but 65 mg or less per 1 m.

Therefore, the content of the lubricant in the cellulose acetate band can be set to a relatively small content in a range required to produce the cellulose acetate band. Thus, in a case where the cellulose acetate fibers, in which the content of titanium oxide is set as described above, is, for example, guided or crimped in a predetermined direction, decrease of frictional forces externally applied to the cellulose acetate fibers can be prevented. In particular, faulty crimping due to decreased frictional resistance during crimping of the cellulose acetate fibers can be suppressed. Therefore, a high-quality cellulose acetate band can be stably produced.

In the spinning, the cellulose acetate fibers having a denier per filament set to a value in a range from 1.0 to 12.0 may be spun. According to this method, the denier per filament may be set to a value in a range from 1.0 to 12.0. Furthermore, a cellulose acetate band containing substantially no titanium oxide can be stably produced.

The method may further include crimping the cellulose acetate fiber such that a crimping (%) of the band after production calculated based on Equation 1 is set to a value in a range from 10% to 40%; and in the spinning, the cellulose acetate fibers having a denier per filament set to a value in a range of 1.0 or greater but less than 5.0 may be spun;

$$\text{Crimping (\%)}=[L1-L0)/L0]\times 100 \quad \text{[Equation 1]}$$

where L0 is a length of the band in a case where a load of 250 g is applied to the band having a length of 250 mm after production in a direction in which crimp of the cellulose acetate fibers is stretched, and L1 is a length of the band in a case where a load of 2500 g is applied to the band having the length of 250 mm after production in the direction described above.

According to the method described above, in the spinning apparatus, interruption of a relatively thin cellulose acetate fibers, in which the denier per filament is set at a value in a range of 1.0 or greater but less than 5.0, can be prevented during spinning. Furthermore, the cellulose acetate fibers are crimped by crimping apparatus such that the crimping (%) is set to a value in a range from 10% to 40%. Thus, an appropriately crimped cellulose acetate band can be stably produced.

The method may further include crimping the cellulose acetate fibers such that the crimping (%) of the band after production calculated based on Equation 1 is set to a value in a range from 10% to 30%; and, in the spinning, a plurality of the cellulose acetate fibers may be spun such that a denier per filament of the band after production may be set to a value in a range from 5.0 to 9.0 and a total denier is set to a value in a range from 15000 to 20000; and in the applying a lubricant, the lubricant may be applied to the cellulose acetate fibers such that the content of the lubricant in the band measured by the diethyl ether extraction method is set to a value in a range from 10 mg to 30 mg per 1 m;

$$\text{Crimping (\%)}=[L1-L0)/L0]\times 100 \quad \text{[Equation 1]}$$

where L0 is a length of the band in a case where a load of 250 g is applied to the band having a length of 250 mm after production in a direction in which crimp of the cellulose acetate fibers is stretched, and L1 is a length of the band in a case where a load of 2500 g is applied to the band having the length of 250 mm after production in the direction described above.

According to the method described above, by setting the filament denier to a value in a range from 5.0 to 9.0 and the total denier to a value in a range from 15000 to 20000, crimping can be suitably performed to set the crimping (%) to the value in the range described above even when a band having a relatively large denier per filament and a relatively small total denier is used.

The method may further include transporting the cellulose acetate fibers, the transporting including winding the cellulose acetate fibers by a godet roll and transporting the cellulose acetate fibers toward a predetermined discharge direction side;

wherein, in the spinning, the spin dope is extruded from a plurality of spinneret holes of a spinneret in which the plurality of spinneret holes are formed; and a winding speed V2 at which the cellulose acetate fibers are wound by the godet roll is set to a value in a range from 400 m/min to 900 m/min, and a ratio V2/V1 of the winding speed V2 to an extruding rate V1 is set to a value in a range from 1.0 to 1.8, the extruding rate V1 being a rate at which the spin dope is extruded from the plurality of the spinneret holes of the spinneret.

According to the method described above, in the spinning, interruption of the cellulose acetate fibers during spinning of the cellulose acetate fibers can be prevented. Furthermore, the ratio V2/V1 is set to a value in a range from 1.0 to 1.8. Thus, the cellulose acetate fibers can be further efficiently spun while tension is applied to the cellulose acetate fibers.

Furthermore, it is possible to ensure a relatively wide setting range for the ratio V2/V1. Because of this, for example, a plurality of types of cellulose acetate fibers having various denier per filament can be efficiently spun by adjusting the ratio V2/V1 while a same spinneret is being used.

Advantageous Effects of Invention

According to an embodiment of the present invention, it is possible to enhance production efficiency of a cellulose acetate band by preventing interruption of cellulose acetate fibers during spinning of the cellulose acetate fibers.

DESCRIPTION OF EMBODIMENTS

Embodiment

Embodiments of the present invention are described with reference to the drawings. In the explanation below, a transport direction refers to a direction of transporting a cellulose acetate (hereinafter, also referred to as "CA") filament (fiber) 30, yarn 31, end 32, and CA band 33 (hereinafter, also referred to as "band 33").

Figure 1:
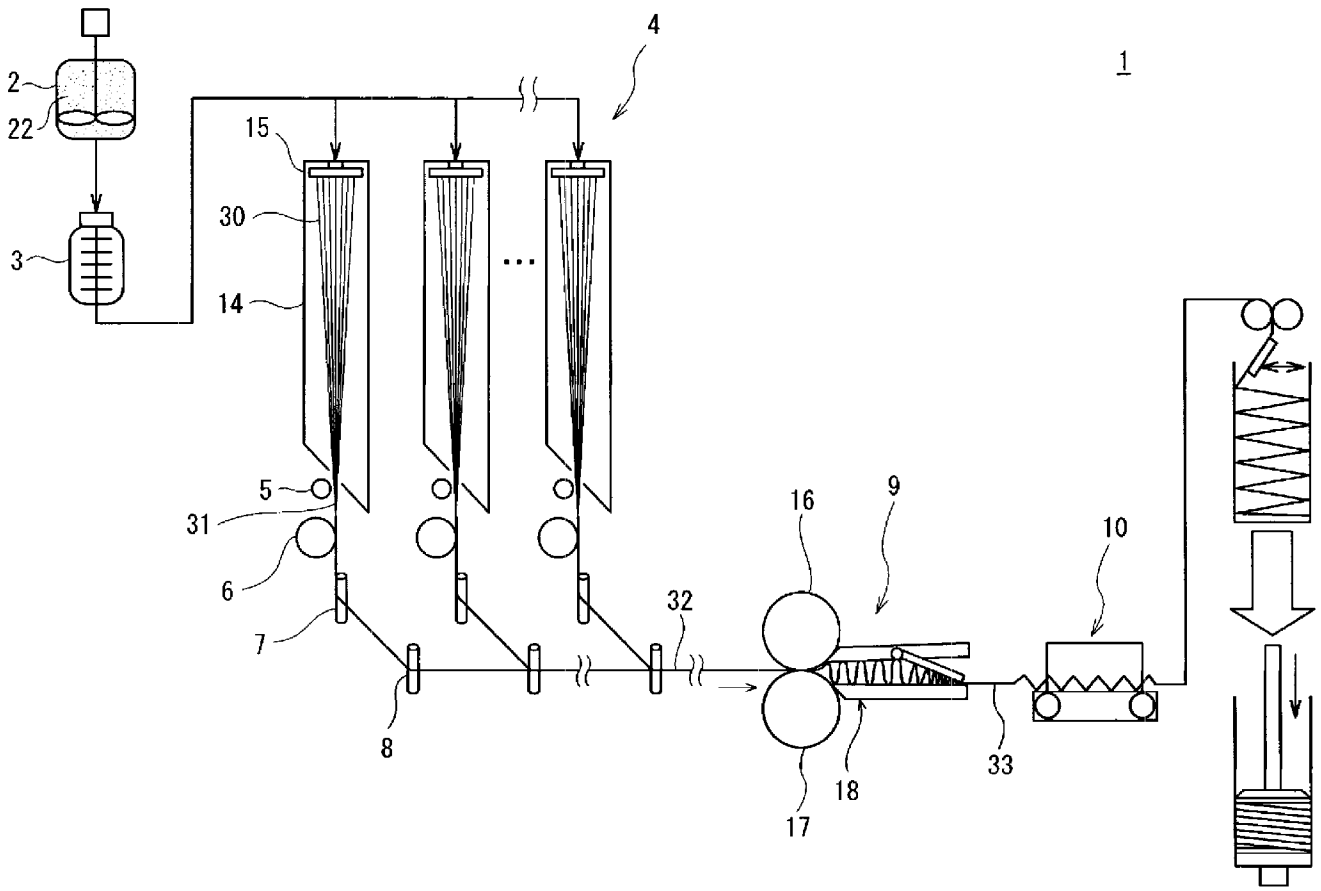
FIG. 1 is a general view of band production apparatus according to an embodiment.

FIG. 1 is a general view of a cellulose acetate band production apparatus 1 (hereinafter, also referred to as "production apparatus 1") The production apparatus 1 spins the CA filament 30 by dry spinning. Furthermore, the production apparatus 1 produces a band 33 from the CA filament 30.

In the production apparatus 1, a spin dope 22, in which cellulose acetate flakes, such as cellulose diacetate, are dissolved in an organic solvent, is used. This spin dope 22 is mixed in a mixing apparatus 2 and then filtered in a filtration apparatus 3. The spin dope 22 that passed through the filtration apparatus 3 is extruded from a plurality of spinneret holes of a spinneret 15 provided in a cabinet 14 of a spinning unit 4. The spin dope extruded from each spinneret hole is dried by vaporizing the organic solvent by hot air supplied into the cabinet 14 from a drying unit, which is not illustrated. Thus, a solid CA filament 30 is formed.

The CA filaments 30 are guided by guide pins 7 and 8, which are guiding devices (also referred to as "guiding"). In these guiding devices, a width of a line of the plurality of the CA filaments 30 is adjusted by the guiding for setting the width. The plurality of the CA filaments 30 that passed through one cabinet 14 are gathered by the guiding for setting the width, thereby forming a yarn 31. The yarn 31 is subjected to application of a lubricant (herein, a lubricant emulsion) by a lubrication unit 5 (as an example, a rotating roll) while the yarn 31 is being guided by the guide pins 7 and 8.

The yarn 31 that underwent application of the lubricant is subjected to adjustment of further narrowing the width of the yarn 31 by the guide pins 7 and 8. Thereafter, the yarn 31 is wound around a godet roll 6. The yarn 31 travels around the circumferential surface of the godet roll 6 only for approximately ¾ of the surface and then taken up by a predetermined winding apparatus. Each of a series of units (i.e., the spinning unit 4 that spins the CA filaments 30 by discharging the spin dope 22 from the spinneret 15, the drying unit, the lubrication unit 5, and the winding unit having the godet roll) that produce the yarn 31 is collectively referred to as a "station". Typically, a plurality of stations are arranged in series.

The yarn 31 is taken up from the circumferential surface of the godet roll 6 in a horizontal direction by the winding apparatus. The guide pins 7 and 8 change the direction of guiding the yarn 31, which passed through each station, by 90°. Each of the yarn 31 is transported along the arrangement direction of the stations and then consecutively accumulated or stacked. Thus, a plurality of the yarns 31 are bundled to form an end (tow) 32, which is a flat assembly of the yarns 31. The end 32 is formed by bundling a plurality of the yarns 31 and finally setting a total denier thereof to a predetermined total denier. The end 32 is transported in a horizontal state and guided to a crimping apparatus 9.

The crimping apparatus 9 has a pair of nip rolls 16 and 17 to push the end 32 into a stuffing box (crimping box) 18. As the pair of the nip rolls 16 and 17 push the end 32 into the stuffing box 18, the end 32 receives resistance from inside of the stuffing box 18. However, the pair of the nip rolls 16 pushes the end 32 into the stuffing box 18 with a force larger than this resistance, imparting crimping to the end 32. Thus, a band 33 is produced. The band 33 that passed through the crimping apparatus 9 is dried by a drying apparatus 10. The band 33 that passed through the drying apparatus 10 is accumulated and then subjected to compression packing to produce a bale.

Note that the method for producing the band 33 of the present embodiment includes preparing the spin dope, filtering the spin dope, transporting the spin dope, spinning, applying a lubricant, guiding, and crimping.

In the preparing the spin dope, a spin dope 22 is prepared. Specifically, as the spin dope 22, a spin dope in which the content of the titanium oxide of the band 33 after production (hereinafter, also simply referred to as "content of titanium oxide") is adjusted to a value in a range from 0 wt. % to 0.01 wt. % is produced. That is, the band 33 of the present embodiment may contain no titanium oxide. Therefore, a "content of titanium oxide being 0 wt. % or greater" refers to both a case where the band 33 contains no titanium oxide and a case where the band 33 contains only a trace amount, which is a detection limit or less, of titanium oxide.

However, the method for producing the band 33 includes the preparing the spin dope, the filtering the spin dope, and the transporting of the spin dope as described above. In a typical production of a band, a band containing titanium oxide is produced. Therefore, the method for producing the band 33 of the present embodiment also includes a case where titanium oxide is unintentionally included in the preparing the spin dope, filtering the spin dope, or the transporting the spin dope.

Note that the content of the titanium oxide in the band 33 after production can be measured by atomic absorption spectrometry or the like. The content of the titanium oxide in the band 33 after production also can be measured in accordance with "Testing methods for man-made filament yarns" stipulated in JIS L 1013:2010. As an apparatus used in the testing method stipulated in this JIS L 1013, an apparatus stipulated in JIS K 0050 can be used. Specifically, the testing method is implemented as described below.

a) Approximately 5 g of the band 33 after production is sampled and an absolute dry mass of the sample is determined. The sample is incinerated to ash in an electric furnace while avoiding intense heat. The ash is transferred into a 200 mL beaker with a little amount of water, and then the water is removed by heating the beaker. Thereafter, 15 mL of concentrated sulfuric acid (guaranteed reagent; specific gravity: 1.84) stipulated in JIS K 8951 and approximately 10 g of ammonium sulfate (guaranteed reagent) stipulated in JIS K 8960 are added and covered by a watch glass. Heating is then performed gradually at the beginning and intensely at the end on a sand bath until the liquid turns transparent.

b) After cooling, water is added to make the total amount approximately 100 mL while ensuring the liquid temperature not to reach 50° C. or higher. This is transferred to a 1 L volumetric flask and diluted with water up to the graduation marking. From this liquid, A mL (an amount which gives absorbance of a color reagent to be from 0.3 to 0.5, depending on the content of titanium oxide and the thickness of a cell) of the liquid is transferred to a 50 mL volumetric flask using a pipet. Then, 5 mL of hydrogen peroxide (3%, guaranteed reagent) stipulated in JIS K 8230 and 10 mL of 1 mol/L sulfuric acid (guaranteed reagent) stipulated in JIS K 8951 are added to the liquid in the volumetric flask to develop a color. The liquid is then diluted with water up to the graduated marking.

c) This liquid in the volumetric flask is transferred to a cell, and the absorbance at the wavelength of 420 nm is measured by using a photoelectric colorimeter. Using a calibration curve produced in advance, the titanium oxide concentration (g/50 mL) is determined based on the measurement. The percentage of the titanium oxide is then calculated based on the following Equation 2. An average value of two measurements is round off to the second decimal place by Rule B stipulated in JIS Z 8401 (rounding method);

$$T1(\%)=((B\times1000)/(C\times A))\times100 \quad \text{[Equation 2]}$$

where T1 is the content of titanium oxide (%), A is the amount of the sampled diluted liquid (mL), B is the titanium oxide concentration (g/50 mL), and C is the absolute dry mass of the sample (g). Note that, besides the atomic absorption spectrometry and the JIS method described above, the content of the titanium oxide of the band 33 after production can be also measured by gravimetry.

In the filtering, the spin dope 22 is filtered. In the spinning, a plurality the CA filaments 30 are spun by using the spin dope 22 produced as described above such that the TD of the band 33 after production is set to a value in a range from 8000 to 44000. Furthermore, the CA filaments 30 are spun such that the FD of the band 33 after production is set to a value in a range from 1.0 to 12.0 (as an example, 1.0 or greater but less than 5.0). The spinning includes extruding and drying. In the extruding, the filtered spin dope 22 is extruded from the spinneret holes of the spinneret 15. In the drying, the CA filaments 30 are solidified by vaporizing acetone in the spin dope 22 by hot-air drying.

In the transporting, the CA filaments 30 are wound by the godet roll 6 and transported toward a predetermined discharge direction side. In the transporting of the present embodiment, a winding speed V2 at the time when the CA filaments 30 are wound by the godet roll 6 is set to a value in a range from 400 m/min to 900 m/min, and a ratio V2/V1 of the winding speed V2 to a discharging speed V1 at the time when the spin dope is extruded from the plurality of the spinneret holes of the spinneret 15 is set to a value in a range from 1.0 to 1.8.

The winding speed V2 is preferably a value in a range from 500 m/min to 900 m/min, and more preferably a value in a range from 550 m/min to 900 m/min. Furthermore, the lower limit of the ratio V2/V1 is preferably a value of 1.1 or greater, and more preferably a value of 1.2 or greater. Furthermore, the upper limit of the ratio V2/V1 is preferably a value of 1.7 or less, and more preferably a value of 1.4 or less.

In the applying a lubricant, a lubricant is applied to the CA filaments 30. This prevents wear and damage caused by the contact between the CA filaments 30 and components of the production apparatus 1. Furthermore, applying the lubricant to the CA filaments 30 facilitates gathering of the plurality of the CA filaments 30.

Specifically, in the applying the lubricant, the lubricant is applied to the CA filaments 30 such that the content of the lubricant in the band 33 after production measured by the diethyl ether extraction method is set to a value in a range of greater than 5 mg but 65 mg or less per 1 m. The content of the lubricant determined by the diethyl ether extraction method can be measured in accordance with JIS L 1013: 2010. Specifically, the diethyl ether extraction method is implemented as described below.

Approximately 5 g of the band 33 after production is sampled and an absolute dry mass of the sample is determined. The sample is placed lightly in a Soxhlet extractor stipulated in JIS R 3503 without any extraction thimble. Thereafter, from 100 mL to 150 mL of diethyl ether (guaranteed reagent) stipulated in JIS K 8103 is placed in an accompanying flask. The accompanying flask is placed in a water bath and heated for 1.5 hours, maintaining gentle boiling of the extraction liquid (the solvent refluxes every 10 minutes through a syphon tube). Thereafter, the solution collected in the sampling part is returned to the accompanying flask. The content of the accompanying flask is concentrated to 10 mL to 15 mL and then, if necessary, filtered through a glass filter (1G1 or 3G1). This is transferred to a weighing bottle, for which a weight has been determined at 105+/−2° C. in advance.

The extraction flask (accompanying flask) is washed with diethyl ether. The washing liquid (after filtration by the glass filter in a case where a glass filter is used) is also added in the weighing bottle, and the solvent is vaporized off in the water bath. Thereafter, it is left in a constant temperature dryer at 105+/−2° C. for 1.5 hours and cooled in a desiccator before weighing the mass of the extract.

The amount of the extract is expressed as a percentage of the diethyl ether extraction amount relative to the absolute dry sample mass. An average value of two measurements is round off to the second decimal place by Rule B stipulated in JIS Z 8401 (rounding method).

In the applying the lubricant of the present embodiment, a lubricant emulsion is applied to the CA filaments 30. This lubricant emulsion contains a lubricant and water. The content of the lubricant in the lubricant emulsion can be set within a predetermined range. The lubricant contains a mineral oil having a Saybolt universal second (SUS) viscosity at 210° C. set at a value in a range of 80 seconds to 130 seconds. Use of such a mineral oil can facilitate guiding of the yarn 31 by imparting appropriate frictional force to the yarn 31 by the guide pins 7 and 8. Furthermore, the end 32 can be appropriately crimped by the crimping apparatus 9. The viscosity of this mineral oil may be a value in a range of 90 seconds to 120 seconds, or a value in a range from 95 seconds to 105 seconds.

Note that, if the content of the lubricant in the band after production measured by the diethyl ether extraction method is greater than 65 mg per 1 m, the production cost of the band may increase. Furthermore, it may become difficult to guide the yarn and the tow by the guide pins 7 and 8. Furthermore, appropriate crimping of the tow by the crimping apparatus 9 may become impossible to perform. Furthermore, in a case where a cigarette filter is produced by using the band, the weight of the band per unit weight of the cigarette filter may decrease, whereby necessary pressure drop may not be achieved.

Furthermore, in a case where the lubricant is not applied to the band or if the content of the lubricant in the band after production measured by the diethyl ether extraction method is less than 5 mg per 1 m, friction to the yarn and the tow due to the contact thereof with the guide pins 7 and 8 and the like becomes greater. As a result, damage and fly may occur.

Furthermore, in a case where the content of the lubricant in the band after production measured by the diethyl ether extraction method is less than 5 mg per 1 m, the lubricant amount applied to the yarn 31 may be reduced during transportation of the yarn 31, and thus retention of the oil film may become difficult. As a result, the traveling position of the yarn 31 may become unstable. Furthermore, the crimping of the end 32 in the crimping described below may become unstable. As a result, a larger amount of fly may be generated. Furthermore, the yarn 31 and the end 32 may be subjected to excessive frictional resistance in the production apparatus 1.

In the guiding, the CA filaments 30, to which the lubricant is applied, is guided by at least one guide member (guide pins 7 and 8). In the guiding, the CA filaments 30 are guided to form the yarn 31. Furthermore, in the guiding, a plurality of the yarns 31 are guided to be combined to form the end 32, which is an assembly of the yarns.

In the crimping, the end 32 is crimped. As an example, in the spinning, the CA filaments 30 having the denier per filament set to a value in a range of 1.0 or greater but less than 5.0 are spun, and, in the crimping, the end 32 (the plurality of the CA filaments 30) is crimped such that the crimping (%) of the band 33 after production calculated by Equation 1 is set to a value in a range from 10% to 40%;

$$\text{Crimping (\%)}=[L1-L0)/L0]\times 100 \quad \text{[Equation 1]}$$

where L0 is a length of the band 33 in a case where a load of 250 g is applied to the band 33 having a length of 250 mm after production in a direction in which crimp of the CA filaments 30 is stretched, and L1 is a length of the band 33 in a case where a load of 2500 g is applied to the band 33 having the length of 250 mm after production in the direction described above. In the present embodiment, each process of the method for producing the band 33 is implemented in the production apparatus 1.

As described above, in a case where the CA filaments are spun by dry spinning, acetone is used as the solvent of the spin dope. In a case where CA filaments are spun by dry spinning with the use of a spin dope in which cellulose acetate is dissolved in acetone, interruption is one of serious problems. "Interruption" refers to breaking of CA filaments that occurs during the dry spinning. Interruption may occur at multiple locations. Major locations where interruption may occur include godet roll, the guide pins, etc., where friction may be generated on the CA filaments.

In recent years, as the use of CA filaments has widened from tobacco to materials for absorbents of sanitary articles, etc., efforts have been made to increase the amount of production of bands by increasing a spinning speed. Accordingly, occurrence of interruption immediately below spinneret holes of the spinneret 15 has increased. The present embodiment also prevents the interruption immediately below the spinneret holes of the spinneret 15.

Increase in the production speed of the band means increase in the spinning speed. Increase in the spinning speed for bands having the same denier per filament (i.e., same FD) means increase in the speed at which the spin dope passes through the spinneret holes (the discharging speed [discharging amount per unit time] of the spin dope from the spinneret holes).

The inventor of the present application has ascertained that one cause of such interruption is titanium oxide present in the produced band. In a case where the spin dope contains titanium oxide, interruption may occur in a case where the discharging speed during the spinning of the CA filaments is increased to a certain degree or higher.

The cause of occurrence of interruption is not clear. However, for example, one possible cause may be that the flow of the spin dope extruded from the spinneret holes becomes unstable through the change in the physical properties, such as viscosity and flowability, of the spin dope due to titanium oxide. In addition, primary particles of titanium oxide present in the spin dope as a solid may be aggregated to form secondary particles. The secondary particles may block at least a part of the spinneret holes of the spinneret and obstruct the flow of the spin dope in the vicinity of the spinneret holes. Thus, in a case where the discharging speed of the spin dope is increased, the interruption may occur frequently due to the problem of the solution viscosity of the spin dope or the unstable flow of the spin dope at the spinneret holes.

Therefore, the present embodiment prescribes that the amount of titanium oxide in the spin dope 22 be as small as possible. Specifically, in the preparing the spin dope of the present embodiment, the added amount of titanium oxide relative to the spin dope 22 is adjusted to substantially 0. Thus, the content of titanium oxide in the band 33 after production is set to a range from 0 wt. % to 0.01 wt. %. Furthermore, in the spinning of the present embodiment, a plurality of the CA filaments 30 are spun by using the spin dope 22 such that the TD of the band 33 after production is set to a value in a range from 8000 to 44000.

Furthermore, in the applying the lubricant, the lubricant is applied to the CA filaments 30 such that the content of the lubricant in the band 33 after production measured by the diethyl ether extraction method is set to a value in a range of greater than 5 mg but 65 mg or less per 1 m.

Thus, the band 33 is formed from the CA filaments 30 and has the TD set to a value in a range from 8000 to 44000. Furthermore, the content of titanium oxide in the band 33 is set to a value in a range from 0 wt. % to 0.01 wt. %.

Furthermore, the content of the lubricant in the band 33 after production measured by the diethyl ether extraction method is set to a value in a range of greater than 5 mg but 65 mg or less per 1 m.

Thus, in producing the band 33, the content of titanium oxide in the spin dope is made as small as possible to an extent where substantially no titanium oxide is included. Therefore, when the CA filaments 30 are spun at a high speed, interruption immediately below a spinneret 15 can be suitably prevented.

Note that the CA filaments containing substantially no titanium oxide receives less frictional force from the guide member, such as the guide pins, since physical properties of these CA filaments differ from those of CA filaments substantially containing titanium oxide. Thus, the CA filaments are less likely to be guided stably by the guide member.

In this case, if the guiding of the yarn is faulty, the yarns in the end, in which a plurality of the yarns transported from each cabinet are arranged, may be distributed unevenly. Due to this unevenness, uniform crimping of the end by the crimping apparatus becomes difficult. Furthermore, the crimp-index of the band is less likely to be increased. Furthermore, the frictional resistance of the end against a pair of the nip rolls of the crimping apparatus is decreased. Thus, a greater amount of fly may be generated because the end is rubbed against the nip rolls.

On the other hand, by setting the content of the lubricant in the band 33 measured by the diethyl ether extraction method to a value in the range described above, the frictional resistance of the CA filaments 30 is increased. Therefore, when the CA filaments 30 having the titanium oxide content set as described above are, for example, guided or crimped in a predetermined direction, decrease in frictional forces exerted to the CA filaments 30 can be prevented. In particular, faulty crimping due to decreased frictional resistance during crimping of the CA filaments 30 can be suppressed. Therefore, a high-quality and highly crimped (large crimping (%)) band 33 can be stably produced.

Furthermore, in a case where a cigarette filter is produced by using the band 33, the band 33 is withdrawn from a packaging box. The band 33 is then opened and formed into a columnar shape by addition of a plasticizer. The lubricant having a relatively high viscosity has been applied to the band 33 by the lubrication unit 5. As a result, by a confirmation test conducted by the inventor, it has been found that the amount of generation of fly at the time of opening the band 33 in production of cigarette filters can be reduced by approximately 10% compared to amounts generated during productions of cigarette filters in the related art.

Note that the TD of the band 33 is preferably at a value in a range of 10000 to 37000, more preferably a value in a range from 12000 to 25000, and particularly preferably a value in a range from 12000 to 22000. Furthermore, the FD of the band 33 is preferably at a value in a range from 3.0 to 10.0, more preferably a value in a range from 3.3 to 9.0, and particularly preferably a value in a range from 5.0 to 9.0.

Furthermore, the content of the lubricant in the band 33 after the production measured by the diethyl ether extraction method is preferably at a value in a range of greater than 5 mg but 45 mg or less per 1 m, more preferably a value in a range greater than 5 mg but 38 mg or less per 1 m, and particularly preferably a value in a range greater than 5 mg but 35 mg or less per 1 m.

Furthermore, for the band 33, the FD is set to a value in a range from 1.0 to 12.0 and the TD is set to a value in a range from 15000 to 44000. Therefore, in a case where CA filaments 30 are spun, interruption can be prevented. Furthermore, flexibility in setting the FD and the TD of the band 33 can be enhanced.

Furthermore, as an example, for the band 33 of the present embodiment, the FD is set to a value in a range of 1.0 or greater but less than 5.0 and the crimping (%) is set to a value in a range from 10% to 40%. Therefore, in a case where CA filaments 30 are spun, interruption can be prevented. Furthermore, the appropriately crimped band 33 can be stably produced.

Note that, for the band 33, the FD is preferably set to a value in a range from 5.0 to 9.0, the TD is preferably set to a value in a range from 15000 to 20000, the content of titanium oxide is preferably set to a value in a range from 0 wt. % to 0.01 wt. %, and the content of the lubricant measured by the diethyl ether extraction method is preferably set to a value in a range from 10 mg to 30 mg per 1 m. In this case, for the band 33, the crimping (%) is preferably set to a value in a range from 10% to 30%.

The band having a relatively large FD is difficult to be crimped in a case where no titanium oxide is included, and in particular, high-crimping is difficult. However, the band 33 of the present embodiment is suitably crimped such that the crimping (%) is set to a value in a range from 10% to 30% because the band 33 contains the lubricant at the amount described above even if a relatively large FD and a relatively small TD are set, with the FD being set to a value in a range from 5.0 to 9.0 and the TD being set to a value in a range from 15000 to 20000.

Specifically, the crimping of the CA filaments 30 is performed on the end 32 (a plurality of the CA filaments 30). The slipping properties of the band 33 vary depending on the content of the lubricant in the band 33. Thus, in the present embodiment, by strictly adjusting the content of the lubricant per unit length (1 m) of the band 33, crimping can be performed suitably even in a case where the band 33 contains substantially no titanium oxide. In particular, even in a case where a band 33 having a large FD and a small TD and containing substantially no titanium oxide is produced, by allowing the band 33 after production to contain the lubricant in the content described above, a crimped band 33 in which the crimping (%) is set to a value in a range from 10% to 30% can be suitably obtained.

Furthermore, according to the method for producing the band 33 described above, in a case where the CA filaments 30 are spun by the spinning unit 4, interruption can be prevented. Furthermore, by setting the ratio V2/V1 to a value in a range from 1.0 to 1.8, the CA filaments 30 can be further efficiently spun while tension is applied to the CA filaments 30.

Furthermore, a relatively wide setting-range for the ratio V2/V1 can be ensured. Thus, for example, a plurality of types of CA filaments 30 having different FDs can be efficiently spun by adjusting the ratio V2/V1 while using the same spinneret 15.

Furthermore, the band 33 contains substantially no titanium oxide. Thus, for example, in a case where the band 33 is used as a material for an absorbent of a sanitary article, even a user who is allergic to titanium oxide can use the sanitary article suitably.

Note that the ratio V2/V1 may be set to a value in a range other than the range described above (e.g., a value in a range greater than 1.8 but 10.0 or less). The winding speed V2 may be set to, for example, a value in a range of 100 m/min or greater but less than 400 m/min. Even when the ratio V2/V1 and the winding speed V2 are set to values in such numerical ranges, the CA filaments 30 can be suitably spun.

Confirmation Test

Test 1

A plurality of the bands, Nos. 1 to 6, having mutually different FDs and TDs were produced, and a preferable range of the lubricant content of each of the bands was measured. Specifically, the target composition of a spin dope 22 was set as follows: 29.0 wt. % of CA (degree of acetyl substitution: 2.5), 68.5 wt. % of acetone, and 2.5 wt. % of water, and thus the spin dope 22, in which the CA was dissolved in the acetone, was produced.

A spinneret 15 having a plurality of spinneret holes each having a triangular orifice shape with a side length of a predetermined length was prepared. The spin dope 22 was heated to 50° C. and filtered by a filtration apparatus 3, and then extruded from the spinneret holes of the spinneret 15 thereby spinning the CA filaments 30. At this time, the spinning speed (winding speed of a pair of nip rolls 16 and 17) was set to 500 m/min.

A lubricant emulsion of a lubrication unit 5 was adjusted such that the lubricant emulsion contains a lubricant as a base (w/o). Specific composition of the lubricant was set as follows: 63 wt. % of a mineral oil having the Saybolt universal viscosity at 210° C. of 80 seconds; 16 wt. % of a sorbitan fatty acid ester; 14 wt. % of a polyoxyethylene sorbitan fatty acid ester; and 7 wt. % of water. This was subjected to emulsification to adjust an oil-in-water lubricant emulsion having a concentration of 5% (the amount of the lubricant was 5 wt. %).

The applied amount of the lubricant for the yarn 31 was adjusted by adjusting the contact pressure between the yarn 31 and the lubrication unit 5. That is, in the applying the lubricant, the amount of the lubricant applied to the CA filaments 30 was changed such that the content of the lubricant per 1 m of the band 33 after production differs.

An end 32 was prepared by spinning under such conditions, and by using the CA filaments 30 to which the lubricant was applied, and the end 32 was crimped by a crimping apparatus 9. Thus, the following bands 33, Nos. 1 to 6 having the FDs and the TDs set to the predetermined values, were obtained. Each of the obtained bands 33 was formed into a (tow) bale by being subjected to compression packing in a packaging box as a band for cigarette filters.

No. 1: The band which had the FD set to 3.0 and the TD set to 35000, and in which a cross-sectional shape in the radial direction was a Y-form (referred to as "3Y35000" in Table 1).

No. 2: The band which had the FD set to 3.0 and the TD set to 28000, and in which a cross-sectional shape in the radial direction was a Y-form (referred to as "3Y28000" in Table 1).

No. 3: The band which had the FD set to 4.0 and the TD set to 25000, and in which a cross-sectional shape in the radial direction was a Y-form (referred to as "4Y25000" in Table 1).

No. 4: The band which had the FD set to 5.0 and the TD set to 20000, and in which a cross-sectional shape in the radial direction was a Y-form (referred to as "5Y20000" in Table 1).

No. 5: The band which had the FD set to 6.0 and the TD set to 17000, and in which a cross-sectional shape in the radial direction was a Y-form (referred to as "6Y17000" in Table 1).

No. 6: The band which had the FD set to 8.0 and the TD set to 15000, and in which a cross-sectional shape in the radial direction was a Y-form (referred to as "8Y15000" in Table 1).

Stability of the guiding of the yarn 31 during the production of each of the bands 33 Nos. 1 to 6 and stability of the end in the crimping apparatus were evaluated. The evaluation of the stability of the guiding of the yarn 31 was performed by checking whether the yarn 31 was appropriately guided by the guide pins 7 and 8.

Specifically, a case where the position of the yarn 31 while this yarn was traveling was constant and did not move relative to the positions of the guide pins 7 and 8 was evaluated as A1. Furthermore, a case where the position of the yarn 31 while this yarn was traveling fluctuated relative to the positions of the guide pins 7 and 8 but the spinning was possible was evaluated as A2. Furthermore, a case where entanglement of the yarn 31 around the guide pins 7 and 8 occurred during a long time of production of the band 33 was evaluated as A3. The evaluation results from best to worst were in the order of A1, A2, and A3.

Furthermore, a case where the position of the end 32 during traveling was constant and did not move relative to the positions of the nip rolls 16 and 17 at the position immediately before the nip rolls 16 and 17 of the crimping apparatus 9 was evaluated as B1. Furthermore, a case where the position of the end 32 during traveling fluctuated occasionally relative to the positions of the nip rolls 16 and 17 at the position immediately before the nip rolls 16 and 17 was evaluated as B2.

Furthermore, a case where the position of the end 32 during traveling was unstable relative to the positions of the nip rolls 16 and 17 at the position immediately before the nip rolls 16 and 17 was evaluated as B3. Furthermore, a case where the position of the end 32 during traveling fluctuated constantly relative to the positions of the nip rolls 16 and 17 at the position immediately before the nip rolls 16 and 17 was evaluated as B4. The evaluation results from best to worst were in the order of B1, B2, B3, and B4.

In this test, the range of the lubricant content per 1 m in the band 33 which resulted in a relatively favorable evaluation result is shown in Table 1. In Table 1, the content (mg) of the lubricant per 1 m in the band 33 after production measured by the diethyl ether extraction method is shown.

Furthermore, in this test, the evaluation result for stability of the guiding of the yarn 31 and the evaluation result for stability at an entrance of the crimping apparatus 9 (the position immediately before the pair of the nip rolls 16 and 17) of the end 32 are shown in Table 2.

In Table 2, the lubrication application conditions X1 to X10 are shown. Among the lubrication application conditions X1 to X10, in the order of from X1 to X10, the contact pressure between the yarn 31 and the lubrication unit 5 increased consecutively and the applied amount of the lubricant to the yarn 31 increased consecutively.

TABLE 1

| Lubrication application conditions | Content of lubricant per 1 m of band after production (mg)* | | | | | |
|---|---|---|---|---|---|---|
| | No. 1 (3Y35000) | No. 2 (3Y28000) | No. 3 (4Y25000) | No. 4 (5Y20000) | No. 5 (6Y17000) | No. 6 (8Y15000) |
| X1 | 25.6 | 20.6 | 18.4 | 14.6 | 12.4 | 11.0 |
| X2 | 29.9 | 24.0 | 21.3 | 17.2 | 14.5 | 12.9 |
| X3 | 34.2 | 27.4 | 24.4 | 19.6 | 16.6 | 14.6 |
| X4 | 38.5 | 30.8 | 27.5 | 22.0 | 18.7 | 16.5 |
| X5 | 42.8 | 34.2 | 30.6 | 24.4 | 20.8 | 18.4 |
| X6 | 47.1 | 37.6 | 33.7 | 26.8 | 22.9 | 20.1 |
| X7 | 51.4 | 41.0 | 36.6 | 29.4 | 25.0 | 22.0 |
| X8 | 55.7 | 44.4 | 39.7 | 31.8 | 27.1 | 23.9 |
| X9 | 59.8 | 48.0 | 42.8 | 34.4 | 29.0 | 25.6 |
| X10 | 64.1 | 51.4 | 45.9 | 36.6 | 31.1 | 27.5 |

*Value measured by diethyl ether extraction method

TABLE 2

| Lubrication application conditions | Stability of guiding of yarn and stability of end at entrance of crimping apparatus | | | | | |
|---|---|---|---|---|---|---|
| | No. 1 (3Y35000) | No. 2 (3Y28000) | No. 3 (4Y25000) | No. 4 (5Y20000) | No. 5 (6Y17000) | No. 6 (8Y15000) |
| X1 | A1/B1 | A1/B1 | A1/B1 | A1/B1 | A1/B1 | A1/B1 |
| X2 | A1/B1 | A1/B1 | A1/B1 | A1/B1 | A1/B1 | A1/B1 |
| X3 | A1/B1 | A1/B1 | A1/B1 | A1/B1 | A1/B1 | A1/B1 |
| X4 | A1/B1 | A1/B1 | A1/B1 | A1/B1 | A1/B1 | A1/B1 |
| X5 | A2/B2 | A1/B1 | A1/B1 | A2/B2 | A1/B1 | A1/B1 |
| X6 | A2/B3 | A2/B2 | A2/B2 | A2/B2 | A1/B1 | A1/B1 |
| X7 | A3/B3 | A2/B2 | A2/B2 | A3/B3 | A2/B2 | A1/B1 |
| X8 | A3/B3 | A3/B3 | A2/B2 | A3/B3 | A2/B2 | A2/B2 |
| X9 | A3/B3 | A3/B3 | A3/B3 | A3/B3 | A3/B3 | A2/B2 |
| X10 | A3/B3 | A3/B3 | A3/B3 | A3/B4 | A3/B3 | A3/B3 |

As shown in Table 1, overall, for the bands 33 (Nos. 1 to 6), it was found that a relatively favorable result was obtained when the content of the lubricant per 1 m in each band was in a range from 11.0 mg to 64.1 mg.

Furthermore, as shown in Table 2, for Nos. 4 to 6, that is, in cases where the FDs were in a range from 5.0 to 8.0 and the TDs were in a range from 15000 to 20000, it was found that a favorable result was particularly obtained when the content of the lubricant in the band 33 per 1 m was in a range from 11.0 mg to 27 mg.

Furthermore, according to other study of the present inventors, overall, for the bands of Nos. 1 to 6, it was found that an even more favorable result was obtained when the content of the lubricant per 1 m of each band was in a range 15.0 mg or greater but less than 42.8 mg.

Furthermore, for the bands of Nos. 1 to 6, it was found that a favorable result was obtained when the content of the lubricant per 1 m of each of the bands was greater than 5.0 mg, or particularly 11.0 mg or greater.

Therefore, it was found that, for a band containing no titanium oxide, a favorable result was obtained for a certain extent even in a case where the value was in a range less than the lower limit (mg) shown in Table 1.

Furthermore, as is clear from Tables 1 and 2, it was found that, for a band having a large FD and a small TD and having no titanium oxide, it is important to set the content of the lubricant lower than that of a typical band (band of 3Y35000 of No. 1) to achieve stable production. Then, Examples 1 to 4 and Comparative Examples 1 to 2 were prepared as described below, and a plurality of confirmation tests were performed. The crimp-index (number/inch) of each of Examples 1 to 4 and Comparative Examples 1 to 2 was measured according to a measurement method described in JP H7-316975 A in which an image of a surface of a band, which was irradiated with light, was captured by imaging means and then the captured image was processed by a computer.

EXAMPLES

Example 1

A spin dope 22, in which the CA was dissolved in the acetone, was produced to have a target composition set as follows: 29.0 wt. % of CA (degree of acetyl substitution: 2.5), 68.5 wt. % of acetone, and 2.5 wt. % of water. That is, the band 33 of Example 1 contained no titanium oxide.

A spinneret 15 having 600 spinneret holes each having a triangular orifice shape with a side length of 60 μm was prepared. The spin dope 22 was heated to 50° C. and filtered by a filtration apparatus 3, and then extruded from the spinneret holes of the spinneret 15 thereby spinning the CA filaments 30. At this time, the spinning speed (winding speed of the pair of the nip rolls 16 and 17) was set to 500 m/min.

A lubricant emulsion of a lubrication unit 5 was prepared such that lubrication unit 5 contains a lubricant as a base (w/o). Specific composition of the lubricant was set as follows: 63 wt. % of a mineral oil having the Saybolt universal viscosity at 210° C. of 80 seconds, 16 wt. % of a sorbitan fatty acid ester, 14 wt. % of a polyoxyethylene sorbitan fatty acid ester, and 7 wt. % of water. This was subjected to emulsification thereby preparing an oil-in-water lubricant emulsion having a concentration of 5% (the amount of the lubricant was 5 wt. %). The applied amount of the lubricant for the yarn 31 was adjusted by adjusting the contact pressure between the yarn 31 and the lubrication unit 5, and the content of the lubricant in the band 33 after production measured by the diethyl ether extraction method was set to 55.7 mg per 1 m.

An end 32 was prepared by spinning under such conditions and by using the CA filaments 30 to which the lubricant was applied, and the end 32 was crimped by a crimping apparatus 9. A band 33 of Example 1, in which the FD was set to 3.0 and the TD was set to 35000, was obtained. The crimp-index of the band 33 of Example 1 was set to 34.0 per inch. The obtained band 33 was formed into a (tow) bale by being subjected to compression packing in a packaging box as a band for cigarette filters.

Example 2

A band 33 of Example 2, in which the FD was set to 3.0 and the TD was set to 35000, was obtained by the same method as in Example 1 except for adjusting the content of the lubricant in the band 33 after production measured by the diethyl ether extraction method to 41.0 mg per 1 m and using 67.5 parts of a mineral oil having the Saybolt universal viscosity at 210° C. of 100 seconds as a mineral oil included in the lubricant emulsion. That is, the band 33 of Example 2 contained no titanium oxide. The crimp-index of the band 33 of Example 2 was set to 34.0 per inch.

Example 3

A band 33 of Example 3, in which the FD was set to a value in a range of greater than 2.7 but less than 3.0 and the TD was set to 35000, was obtained by the same method as in Example 1 except for performing the spinning by using a spinneret 15 having 350 spinneret holes each having a triangular orifice shape with a side length of 58 μm, and adjusting the content of the lubricant in the band 33 after production measured by the diethyl ether extraction method to 41.0 mg per 1 m. That is, the band 33 of Example 3 contained no titanium oxide. The crimp-index of the band 33 of Example 3 was set to 34.0 per inch.

Example 4

A band 33 of Example 4, in which the FD was set to 2.7 and the TD was set to 35000, was obtained by the same method as in Example 1 except for performing the spinning by using a spinneret 15 having 600 spinneret holes each having a triangular orifice shape with a side length of 56 μm, and changing the crimp-index by the setting of the crimping apparatus 9. That is, the band 33 of Example 4 contained no titanium oxide. The crimp-index of the band 33 of Example 4 was set to 33.5 per inch.

Comparative Example 1

A band of Comparative Example 1 was obtained by the same method as in Example 1 except for preparing a spin dope by setting a target composition thereof as 28.9 wt. % of CA, 0.1 wt. % of titanium dioxide, 68.5 wt. % of acetone, and 2.5 wt. % of water. The crimp-index of the band 33 of Comparative Example 1 was set to 34.0 per inch.

Comparative Example 2

A band of Comparative Example 2 was obtained by the same method as in Example 3 except for preparing a spin dope to have a target composition set as 28.9 wt. % of CA, 0.1 wt. % of titanium dioxide, 68.5 wt. % of acetone, and 2.5 wt. % of water. The crimp-index of the band 33 of Comparative Example 2 was set to 34.0 per inch. The setting conditions of these Examples 1 to 4 and Comparative Examples 1 and 2 are shown in Table 3.

TABLE 3

| | Example 1 | Example 2 | Example 3 | Example 4 | Comparative Example 1 | Comparative Example 2 |
|---|---|---|---|---|---|---|
| FD | 3.0 | 3.0 | 3.0 | 2.7 | 3.0 | 3.0 |
| TD | 350000 | 350000 | 350000 | 350000 | 350000 | 350000 |
| Content of titanium oxide | 0 | 0 | 0 | 0 | 0.1 | 0.1 |
| Content of lubricant per 1 m of band after production (mg) | 55.7 | 41.0 | 41.0 | 55.7 | 55.7 | 41.0. |
| Crimp-index of band after production (number/inch) | 34.0 | 34.0 | 34.0 | 33.5 | 34.0 | 34.0 |

Test 2

The dynamic coefficient of friction between each yarn and a guide pin 7 at the time when each yarn of Example 1 and Comparative Example 1 was guided by the guide pin 7 of the production apparatus 1 was measured. Specifically, a plurality of guide pins 7 (diameter: 10 mm) each having a fixed surface roughness at a region in contact with the yarn was prepared. The contact angle θ of the yarn relative to the guide pin 7 was set to 135°. The contact angle θ herein is defined as an angle between a yarn positioned on a transport direction side of the guide pin 7 and a yarn positioned on a discharge direction side of the guide pin 7, when seen from an axial direction of a guide pin 7.

With these guide pins 7 being used, the yarn was wound at a predetermined winding speed by the winding apparatus at a position toward the discharging direction side of the guide pins 7 of the production apparatus 1. During the winding, a difference between a tension T1 of the yarn between the godet roll 6 and the guide pin 7 and a tension T2 of the yarn between the guide pin 7 and the winding apparatus, (T2−T1), was calculated as a frictional tension. Note that, for this calculation method, for example, description in JP 2004-068198 A can be referenced.

The winding speed of the yarn in the winding apparatus was set to any of 200, 400, 600, 800, or 1000 m/min. Furthermore, the dynamic coefficient of friction was calculated based on the following Equation 3 by using the frictional tension value calculated as described above and the contact angle θ [rad].

$$\text{Dynamic coefficient of friction } (\mu d) = 1/\theta \log(T2/T1) \quad \text{[Equation 3]}$$

The measurement results are shown in Table 4.

TABLE 4

| Yarn used | Example 1 | Comparative Example 1 |
|---|---|---|
| Dynamic coefficient of friction (μd) at winding speed of 200 [m/min] | 0.165 | 0.243 |
| Dynamic coefficient of friction (μd) at winding speed of 400 [m/min] | 0.188 | 0.241 |

TABLE 4-continued

| Yarn used | Example 1 | Comparative Example 1 |
|---|---|---|
| Dynamic coefficient of friction (μd) at winding speed of 600 [m/min] | 0.201 | 0.241 |
| Dynamic coefficient of friction (μd) at winding speed of 800 [m/min] | 0.196 | 0.235 |
| Dynamic coefficient of friction (μd) at winding speed of 1000 [m/min] | 0.198 | 0.241 |

As is clear from Table 4, it was found that the dynamic coefficient of friction of the yarn 31 of Example 1 varied depending on the winding speed. The dynamic coefficient of friction of the yarn 31 of Example 1 became maximum at the winding speed of 600 m/min, however, the dynamic frictional resistance decreased for both cases, where the winding speed was set to a lower speed and where the winding speed was set to a higher speed. On the other hand, the yarn of Comparative Example 1 exhibited higher dynamic frictional resistances against higher winding speeds substantially consistently. From the results shown in Table 3, it was confirmed that the dynamic coefficient of friction between the yarn and the guide pin is smaller in a case where the yarn contains no titanium oxide compared to a case where the yarn contains titanium oxide.

Test 3

The low speed frictional force (g) acting on the yarn from the guide pins 7 and 8 during the guiding of the yarn by the guide pins 7 and 8 in each of Examples 1 and 2 and Comparative Example 1 was measured. Specifically, a yarn was wound 450° (5/4 turns) around a metal pin (serving each of the guide pins 7 and 8) having a diameter of 1.5 mm arranged to extend in a horizontal direction.

In this state, a predetermined load S1 (herein, 30 g) was hung from one end of the yarn to apply the load, and the other end of the yarn was passed through a spring balance having a pulley positioned above the metal pin.

Therefore, by the pulley of the spring balance having a pulley, the other end of the yarn was turned around by 180° and guided downward toward the side of the one end of the yarn. The other end of the yarn was wound around a winding roll at a winding speed of 3 cm/min. During the winding, a tension S2 acting on the yarn was measured. Using this measurement value, the low speed frictional force (g) was calculated based on the following Equation 3.

$$\text{Low speed frictional force } (g) = (S2 - S1)/2 \quad \text{[Equation 3]}$$

S1 is a measurement value measured by the spring balance having a pulley. S2 is a load (in this case, 30 g) applied to the one end of the yarn. The calculation results are shown in Table 5.

TABLE 5

| | Example 1 | Example 2 | Comparative Example 1 |
|---|---|---|---|
| Presence/absence of titanium oxide | Absent | Absent | Present |
| Content of lubricant per 1 m of band after production (mg) | 55.7 | 41.0 | 55.7 |

TABLE 5-continued

| | Example 1 | Example 2 | Comparative Example 1 |
|---|---|---|---|
| Low speed frictional force applied on yarn by guide pin (g) | 49.4 | 52.5 | 53 |

As shown in Table 5, it was found that in a case where the band contained no titanium oxide (Example 1), low speed frictional force acting on the yarns from the metal pin having a diameter of 1.5 mm (serving as a guide pin) was slightly reduced compared to a case where the band contained titanium oxide (Comparative Example 1).

However, in a case where the content of the lubricant in the band was reduced similarly to Example 2, it was found that the low speed frictional force acting on the yarn from the metal pin increased to a degree similar to that in Comparative Example 1.

Specifically, it was found that the low speed frictional force acting on the yarn from the metal pin of Example 2 further increased by approximately 5% than the low speed frictional force acting on the yarn by the metal pin of Example 1. Therefore, in Example 2, more stable guiding of the yarn is considered achievable by the frictional force from the guide pins 7 and 8 than in Example 1.

Test 4

In Example 3 and Comparative Example 2, a winding speed V2 of the godet roll was set to one of 700, 800, or 900 m/min, thereby changing an amount of the spin dope supplied to the spinneret. Thus, the draft range in which the spin dope can be stably extruded from the spinneret holes was determined.

Figure 2:
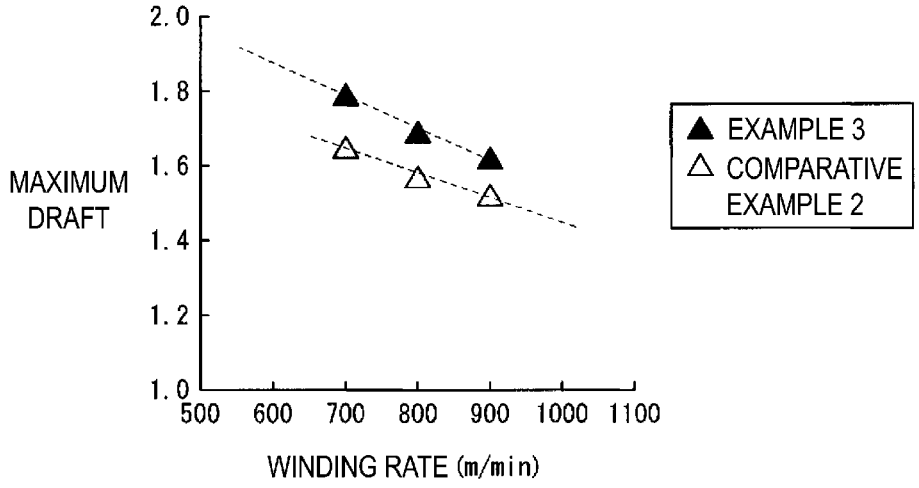
FIG. 2 is a graph showing the relationship between the winding speed of yarns and the maximum draft in an Example and a Comparative Example.

Note that the "draft" is defined as a ratio V2/V1, the ratio of the winding speed V2 to a discharging speed V1. As the amount of the spin dope supplied to the spinneret is reduced, the filaments extruded from the spinneret holes become thinner. Thus, it becomes impossible to wind the CA filaments stably. The ratio V2/V1 when the winding becomes impossible is defined as "maximum draft". The values of maximum draft measured at different winding speeds V2 for Example 3 and Comparative Example 2 are shown in Table 6. FIG. 2 is a graph showing the relationship between the winding speed V2 of yarns and the maximum draft in Example 3 and Comparative Example 2.

TABLE 6

| | | Maximum draft | |
|---|---|---|---|
| | | Example 3 | Comparative Example 2 |
| Presence of titanium oxide | | Absent | Present |
| Winding speed [m/min] | 900 | 1.62 | 1.52 |
| | 800 | 1.69 | 1.57 |
| | 700 | 1.79 | 1.65 |

As shown in Table 6 and FIG. 2, it was found that Example 3 had a greater range of maximum drafts than that of Comparative Example 2 in a range of winding speed at which the test was conducted. Thus, it is thought that, in a case where a band is produced by the embodiment described above, a greater stable range of the draft (range between the lower limit (1.0) of the draft and the upper limit of the draft (maximum draft value)) can be ensured.

By ensuring a greater stable range of the draft, it is possible to prevent interruption caused by a change in at least one of the concentration, viscosity, temperature, or flow path of the spin dope at the time when the CA filaments are spun. As described above, spinnability of the CA filaments is enhanced, and thus enhancement of production efficiency of the CA band is expected.

Furthermore, it was found that Example 3 exhibited greater maximum draft values than those of Comparative Example 2 in a range of the winding speeds at which the tests were conducted. By increasing the maximum draft values as such, flexibility in draft setting can be enhanced. That is, it becomes possible to widen the range of the FD of the CA filaments 30 that a same spinneret 15 can produce.

Specifically, for example, using the same spinneret 15, CA filaments 30 having a large FD can be spun by reducing the draft value, and CA filaments 30 having a small FD can be spun by increasing the draft value.

Therefore, even in a case in related art where, CA filaments 30 having a small FD, which may suffer interruption unless replaced with a spinneret 15 having a smaller orifice diameter of the spinneret holes, are spun, the CA filaments 30 can be stably spun by adjusting the draft value without replacing the spinneret 15. Thus, a plurality of types of CA filaments 30 having various FDs can be efficiently produced with the use of the same spinneret 15 without stopping the production line to replace the spinneret 15.

Furthermore, CA filaments 30 having different FDs can be efficiently spun by adjusting the draft value by using the same spinneret 15. Therefore, for example, the orifice diameter of the spinneret hole can be set to a relatively large value. Thus, even in a case where the spin dope 22 contains impurities having a certain size, it is possible to prevent the spinneret hole of the spinneret 15 from being clogged with the impurities. Thus, the CA filaments 30 may be stably spun.

Test 5

The crimping (%) of the band 33 of Example 4 was measured using a

Band Tester G02, which is a tester available from Borgwardt. For this measurement, nine pieces of the band (length: 250 mm) of Example 4 were prepared, in which crimping were performed such that the values of the crimping (%) of the pieces differ from each other, by implementing setting on the crimping apparatus 9 (for example, adjusting a space between a pair of the nip rolls 16 and 17 or adjusting an inclination angle of a pair of top and bottom plate-like members arranged in the stuffing box 18 (see FIG. 1) relative to a horizontal direction.

With the position of one end of the band 33 in a direction of extension of the crimping of the CA filaments 30 being fixed, and the other end of the CA filaments 30 in the band 33 being fixed on a measurement head of the tester, lengths L0 and L1 were measured by causing the measurement head to move along the direction described above at a moving speed of 300 mm/min.

According to this measurement method, the values of the crimping (%) of the measured nine pieces of the band 33 of Example 4 were in a range of 18% to 32%. As a result, it was found that the crimping (%) of the band 33 of Example 4 was set to a value in a range from 10% to 40%.

The present invention is not limited by the embodiments, and the configuration and the method therefor can be changed, added, or deleted, without departing from the scope of the present invention.

INDUSTRIAL APPLICABILITY

As described above, the embodiments of the present invention achieve excellent effects that makes it possible to enhance production efficiency of a cellulose acetate band by preventing interruption of cellulose acetate fibers during spinning of the cellulose acetate fibers. It is thus advantageous to widely apply then embodiments of the present invention to a cellulose acetate band and a method for producing a cellulose acetate band that can make the best of the effects.

REFERENCE SIGNS LIST

6 Godet roll
15 Spinneret
22 Spin dope
30 Cellulose acetate fiber
33 Cellulose acetate band

The invention claimed is:

1. A cellulose acetate band for cigarette filters formed from uniformly crimped cellulose acetate fibers, a total denier thereof being set to a value in a range from 8000 to 44000, a content of titanium oxide therein being set to a value in a range from 0 wt. % to 0.01 wt. %, a content of a lubricant in the cellulose acetate band measured by a diethyl ether extraction method being set to a value in a range of greater than 5 mg but 65 mg or less per 1 m, and a denier per filament thereof is set to a value in a range from 8.0 to 12.0, wherein crimping (%) of the cellulose acetate band calculated by Equation 1 is set to a value in a range from 10% to 40%;

$$\text{Crimping (\%)}=[(L1-L0)/L0]\times 100 \quad \text{[Equation 1]}$$

where L0 is a length of the cellulose acetate band in a case where a load of 250 g is applied to the cellulose acetate band having a length of 250 mm in a direction in which crimp of the crimped cellulose acetate fibers is stretched, and L1 is a length of the cellulose acetate band in a case where a load of 2500 g is applied to the cellulose acetate band having the length of 250 mm in the direction.

2. The cellulose acetate band according to claim 1, wherein the total denier is set to a value in a range from 15000 to 20000, the content of the lubricant in the cellulose acetate band measured by the diethyl ether extraction method is set to a value in a range from 10 mg to 30 mg per 1 m, and the crimping (%) of the cellulose acetate band calculated by Equation 1 is set to a value in a range of 10% to 30%.

3. The cellulose acetate band according to claim 1, wherein the content of the lubricant in the cellulose acetate band measured by the diethyl ether extraction method is set to a value in a range of 55.7 mg to 65 mg per 1 m.

* * * * *